US008910812B2

(12) United States Patent
Pedmo

(10) Patent No.: US 8,910,812 B2
(45) Date of Patent: Dec. 16, 2014

(54) CONTAINER WITH GRIP PANEL AND ANNULAR RIB HAVING VARIABLE WIDTH

(75) Inventor: Marc A. Pedmo, Litchfield, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 13/307,315

(22) Filed: Nov. 30, 2011

(65) Prior Publication Data

US 2013/0134125 A1 May 30, 2013

(51) Int. Cl.
*B65D 1/02* (2006.01)

(52) U.S. Cl.
CPC ..... *B65D 1/0207* (2013.01)
USPC ..... 215/384; 215/385; 215/371; 215/378; 220/669; 220/675

(58) Field of Classification Search
USPC ..... 215/381, 382, 383, 384, 385, 371, 378; 220/669, 675, 676
See application file for complete search history.

(56) References Cited

U.S. PATENT DOCUMENTS

| | | | | |
|---|---|---|---|---|
| 5,758,790 | A | 6/1998 | Ewing, Jr. | |
| 5,971,184 | A | 10/1999 | Krishnakumar et al. | |
| 6,062,409 | A | 5/2000 | Eberle | |
| 6,095,360 | A * | 8/2000 | Shmagin et al. | 215/382 |
| 6,223,920 | B1 | 5/2001 | Lane et al. | |
| 6,974,047 | B2 | 12/2005 | Kelley et al. | |
| 7,159,729 | B2 * | 1/2007 | Sabold et al. | 215/382 |
| D592,964 | S | 5/2009 | Kissinger et al. | |
| 7,604,140 | B2 | 10/2009 | Pritchett, Jr. et al. | |
| 7,661,548 | B2 | 2/2010 | Shmagin | |
| 7,810,664 | B2 | 10/2010 | Trude | |
| 7,959,024 | B2 * | 6/2011 | Pedmo et al. | 215/381 |
| 8,028,498 | B2 * | 10/2011 | Melrose | 53/281 |
| 2002/0162820 | A1 | 11/2002 | Saito et al. | |
| 2005/0035083 | A1 * | 2/2005 | Pedmo et al. | 215/381 |
| 2005/0035084 | A1 | 2/2005 | Simpson, Jr. et al. | |
| 2005/0139572 | A1 * | 6/2005 | Pedmo et al. | 215/381 |
| 2005/0252880 | A1 * | 11/2005 | Pedmo et al. | 215/381 |
| 2005/0269284 | A1 * | 12/2005 | Pedmo et al. | 215/381 |
| 2005/0284840 | A1 * | 12/2005 | Pedmo et al. | 215/381 |
| 2008/0110854 | A1 * | 5/2008 | Kelly | 215/384 |
| 2009/0166314 | A1 | 7/2009 | Matsuoka | |
| 2010/0163513 | A1 | 7/2010 | Pedmo | |
| 2010/0230378 | A1 * | 9/2010 | Colloud | 215/384 |

OTHER PUBLICATIONS

Commissioner for Patents; International Search Report and Written Opinion issued in corresponding International Application No. PCT/US2012/086845 Date of Mailing: Jan. 28, 2013.

* cited by examiner

*Primary Examiner* — Robert J Hicks
*Assistant Examiner* — Kareen Rush
(74) *Attorney, Agent, or Firm* — Dykema Gossett PLLC

(57) ABSTRACT

A plastic container includes a base, a neck portion with a dispensing opening, and a body portion. The body portion includes a horizontally-extending annular rib and a grip panel. The horizontally-extending annular rib may extend around the circumference of the body portion. The annular rib includes a variable vertical width and includes a pinch segment that is circumferentially and longitudinally offset from the grip panel. With some embodiments, the plastic container includes two grip panels and/or at least two horizontally-extending annular ribs.

21 Claims, 19 Drawing Sheets

CONTAINER WITH GRIP PANEL AND ANNULAR RIB HAVING VARIABLE WIDTH

TECHNICAL FIELD

The invention relates to plastic containers, including molded plastic containers that are suitable for being filled with liquid at elevated temperatures and have a grip panel and a horizontally-extending annular rib with a variable width.

BACKGROUND

Molded plastic containers for packaging contents at elevated temperatures, such as "hot-fill" beverages, are known in the art. Once liquid contents that fill a container at elevated temperatures are permitted to cool, an internal pressure or vacuum is generated. In the absence of structural features for accommodating such internal pressure or vacuum forces, the container may deform. For example, a round container may experience ovalization, or tend to distort and become out of round.

Conventional hot-fill containers may, for instance, accommodate a vacuum pressure, which can be significant, by employing flex panels in the sidewall portion of the container to accommodate a change in internal pressure. For some conventional containers, vacuum panels and pinch-grip portions may be incorporated together. Moreover, some embodiments of hot-fill containers employ a circumferential rib or ring to help reduce distortions, such as ovalization, of the container.

However, in instances in which a hot-fill container is provided with grip panels, as a panel pulls in the sidewall of a container (e.g., in response to internal vacuum or pressures), the inward flexing of the panel can urge a circumferential rib to "open" in the front and back of the container, i.e., where a grip panel is not positioned. As such a circumferential rib "opens," increased ovalization can be imparted on the container.

It is therefore desirable to, among other things, provide a container having a grip portion that is configured to better resist undesired deformation.

SUMMARY

In accordance with aspects of the disclosure a plastic container is provided that includes a base, a neck portion with a dispensing opening, and a body portion. Embodiments of the body portion include one or more horizontally-extending annular ribs and one or more grip panels. In embodiments, the horizontally-extending annular rib extends around the circumference of the body portion, and the annular rib may have a variable vertical width and a pinch segment that is circumferentially and longitudinally offset from the grip panel.

BRIEF DESCRIPTION OF THE DRAWINGS

Embodiments of the invention will now be described, by way of example, with reference to the accompanying drawings, wherein.

DETAILED DESCRIPTION

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention.

Figure 1:
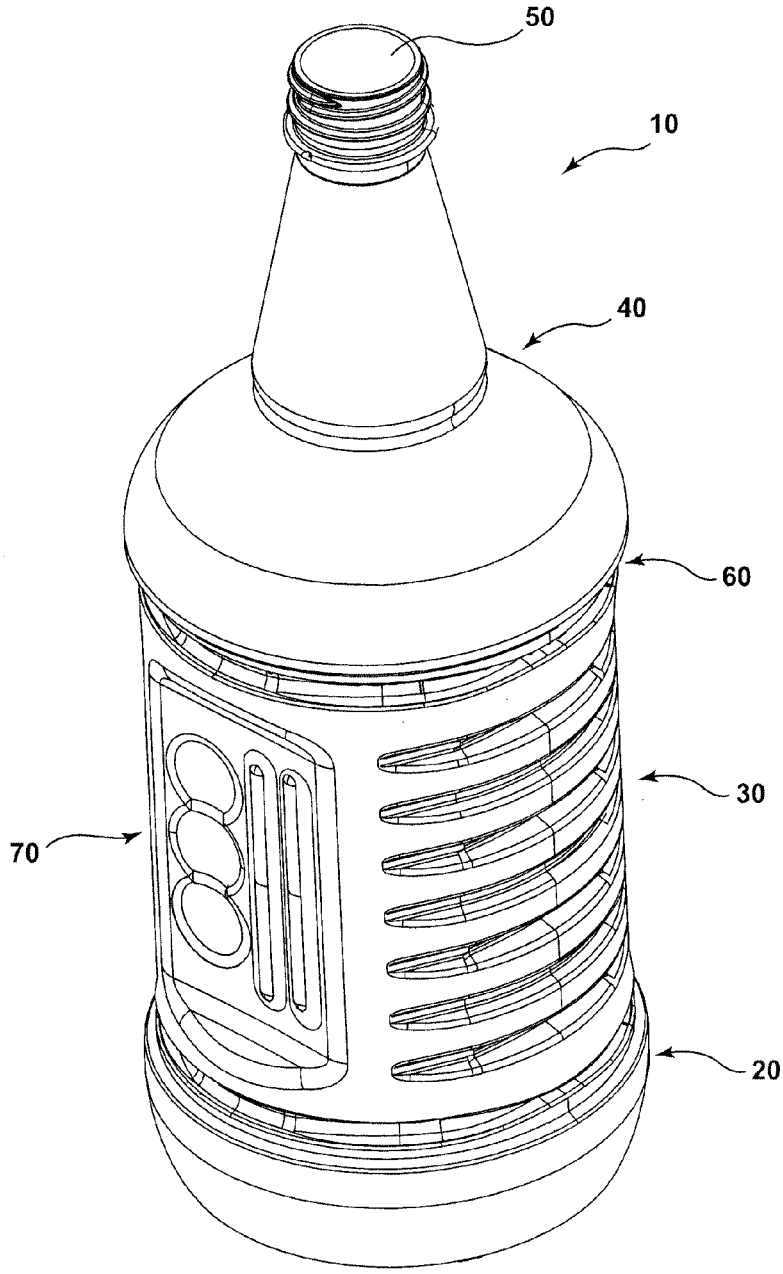
FIG. 1 generally illustrates an isometric view of a container according to an exemplary embodiment of the disclosure.

FIG. 1 illustrates a plastic container 10 provided in accordance with an embodiment of the disclosure. FIGS. 2 through 7 generally show left side, top, front, right side, bottom, and rear views of the container depicted in FIG. 1.

With reference to FIG. 1, the plastic container 10 may include a base 20, a body portion 30, and a neck portion 40 including a dispensing opening 50. The base 20 can be configured to support the container on a support surface. The body portion 30 can include a horizontally-extending annular rib 60 and a grip panel 70. In embodiments, the plastic container 10 may be cylindrical or non-round. A non-round embodiment of a plastic container 10 may, for example, include at least two sides having a non-constant radius.

Figure 2:
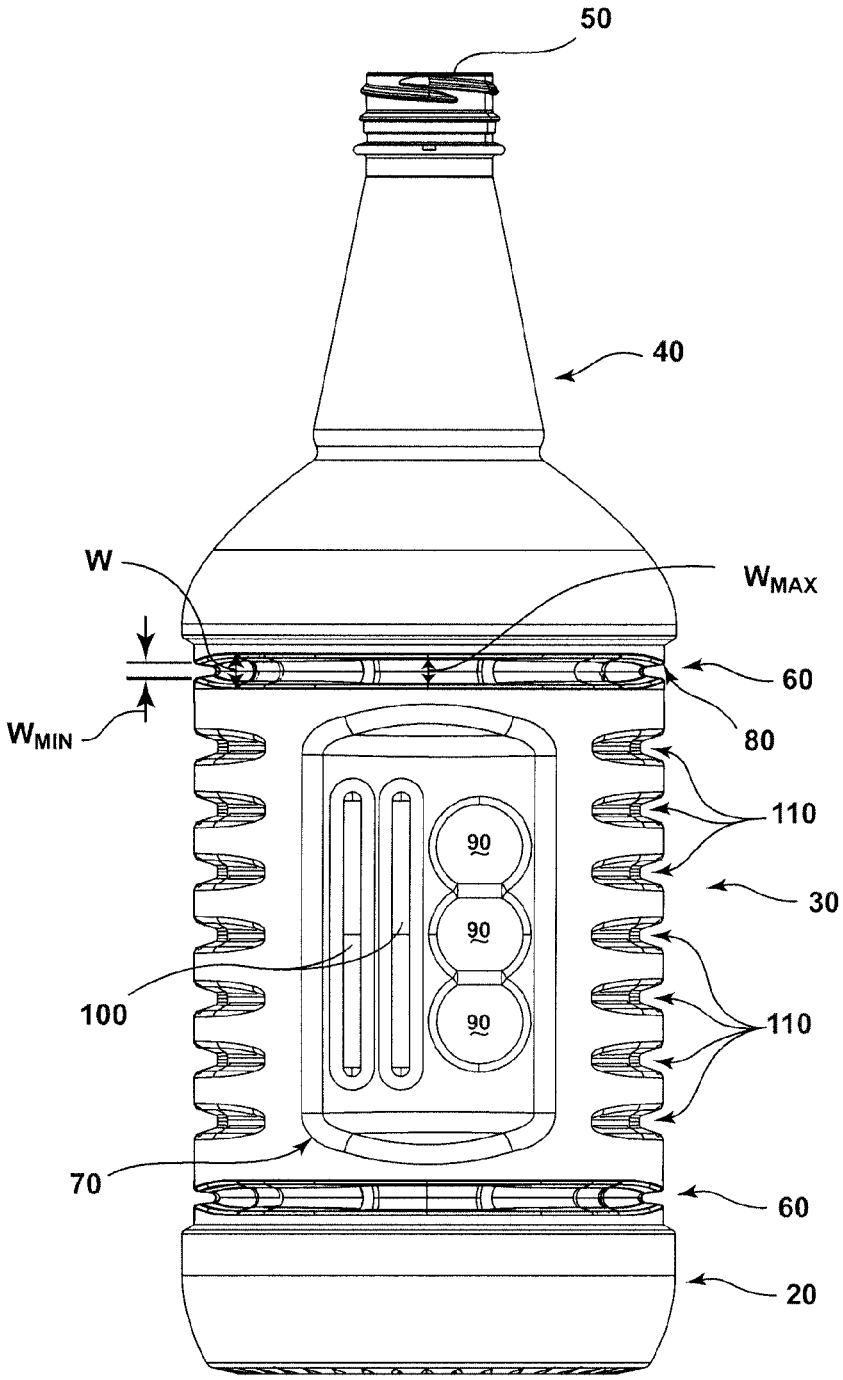
FIG. 2 illustrates a left side view of the container shown in FIG. 1.
Figure 3:
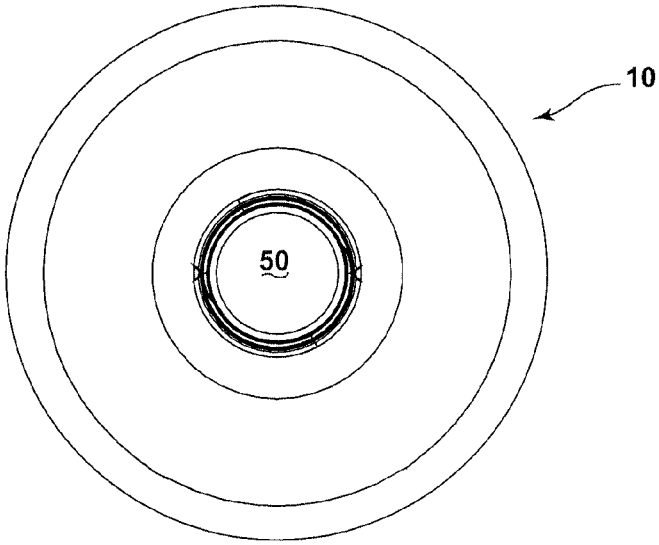
FIG. 3 illustrates a top plan view of the container shown in FIG. 1.
Figure 6:
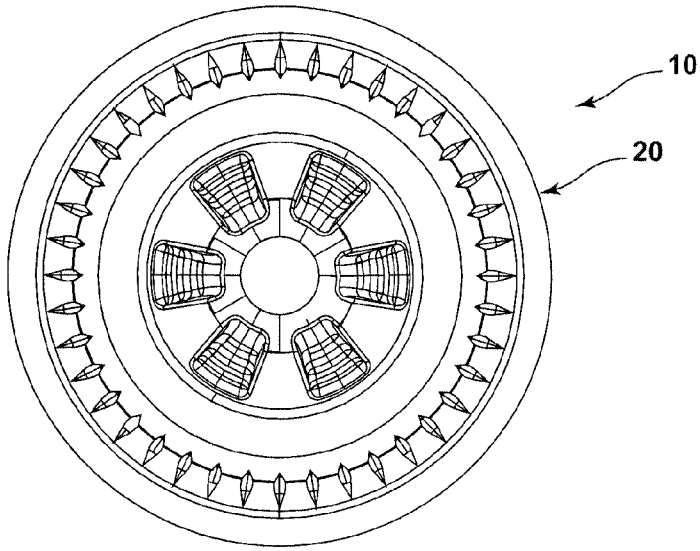
FIG. 6 illustrates a bottom plan view of the container shown in FIG. 1.

As illustrated in FIGS. 1, 2, 4, 5, and 7, the horizontally-extending annular rib 60 may extend around the circumference of the body portion 30. With reference to FIG. 2, the annular rib 60 may have a vertical width W that varies at different positions or segments around the circumference of the body portion 30. Further, as generally shown, the annular rib 60 can be vertically offset—i.e., positioned above and/or below the grip panel(s) 70.

Figure 4:
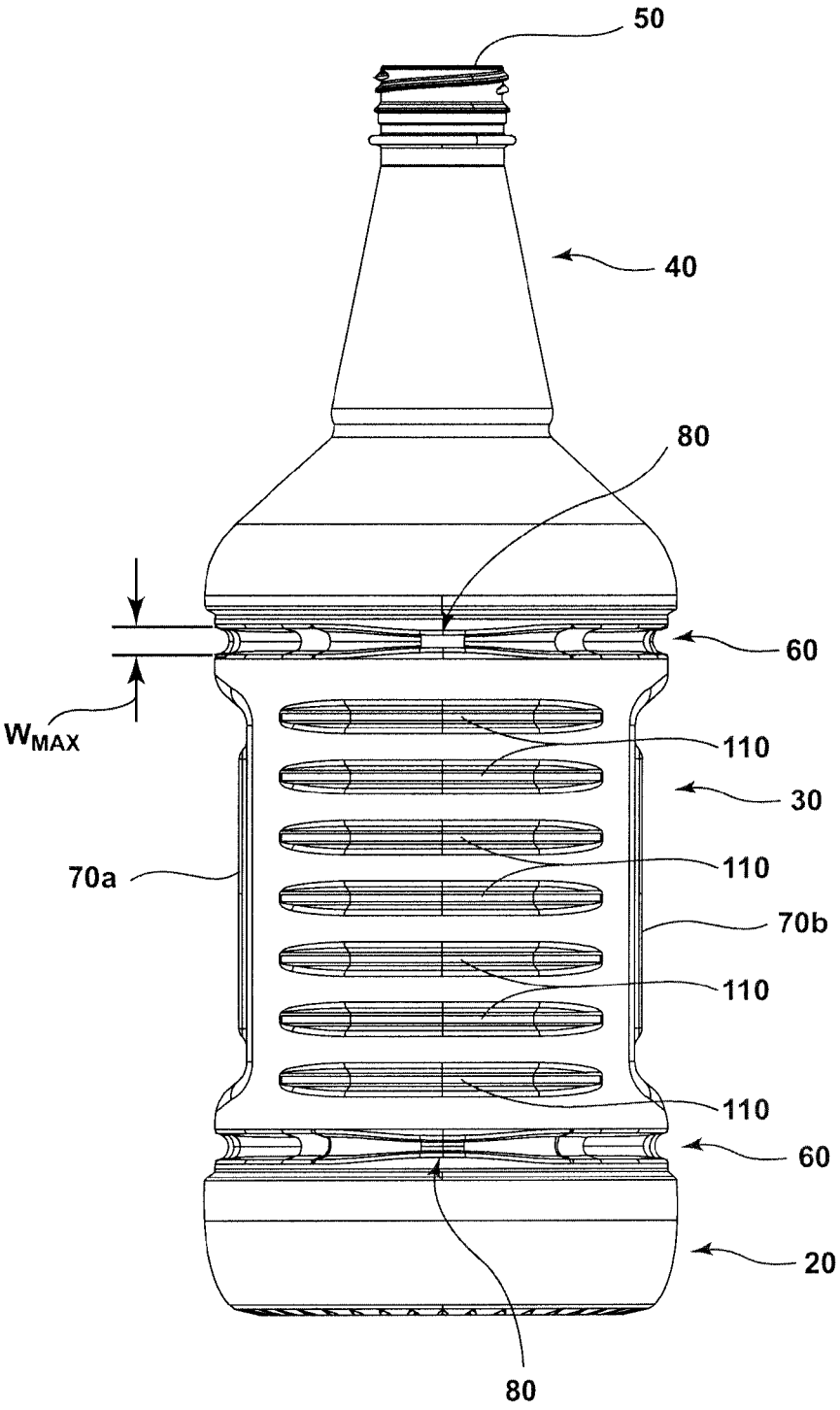
FIG. 4 illustrates a front view of the container shown in FIG. 1.
Figure 22:
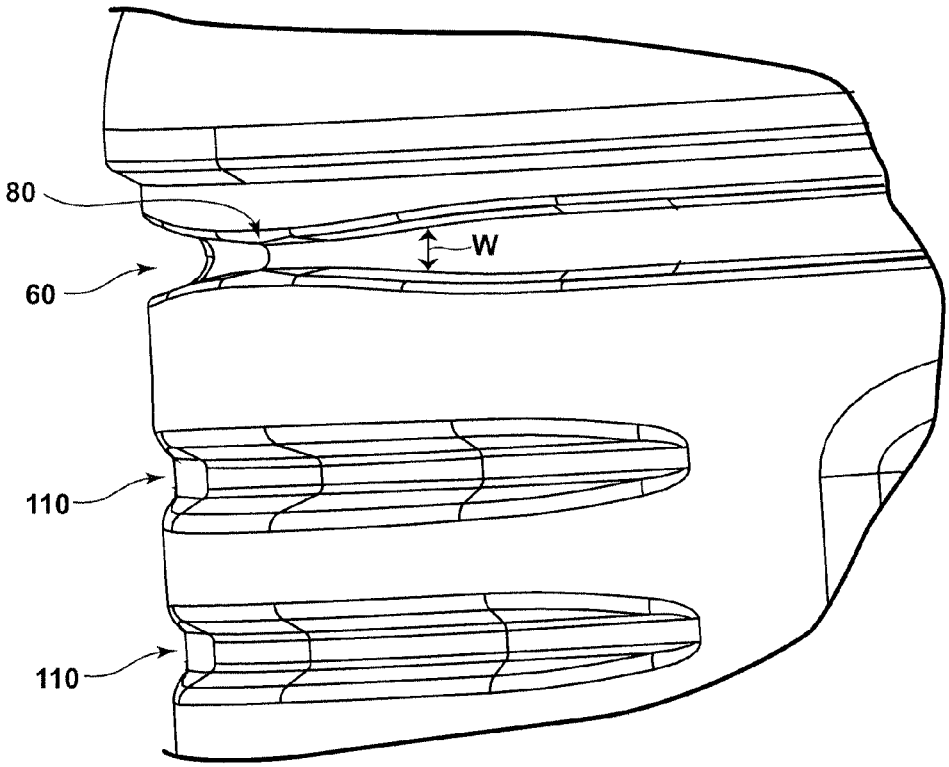
FIG. 22 generally illustrates left side, front, and top isometric view of a portion of a container according to an embodiment such as shown in FIG. 15.

The annular rib 60 can have a maximum vertical width $W_{max}$ (see, e.g., FIG. 2) and minimum vertical width $W_{min}$ (see, e.g., FIG. 4). In embodiments, the annular rib 60 would fit on or within a theoretical annular band having a constant vertical range (equivalent to the maximum vertical width $W_{max}$) that extends horizontally around the container. With reference to FIG. 4, a portion or segment having a narrower vertical width that includes the minimum vertical width $W_{min}$ may comprise a pinch segment (generally designated as 80). In embodiments, such as those generally illustrated, the annular rib 60 may include segments—e.g., illustrated in the left side and right side views (FIGS. 2 and 4)—that have substantially constant vertical width. Such a substantially constant segment may then narrow, i.e., have a reduced vertical width, moving circumferentially along the annular rib into the segments that comprise a pinch segment 80. The narrowing of the annular rib 60 is illustrated in FIG. 22, which depicts the relevant portion of a container having a different upper/neck portion. As generally illustrated in that figure, the vertical width of the annular rib 60 can decrease from a comparatively wider (and constant) vertical width (coming around above the grip panel 70), to a comparatively narrow width (at or about the pinch segment over the front portion of the container). Such a reduction in vertical width can take place within a short circumferential distance, which, by way of example and without limitation, may be within a span of 35 degrees. Moreover, without limitation, for some embodiments, the reduction could be in the range of about 5 degrees to about 180 degrees. Additionally, for some embodiments, the annular rib has a maximum vertical width at circumferential positions provided at about 45°, 135°, 225°, and 315°. Such increased depth at the circumferential "corners" can help constrain the container to collapse in a specific direction and manner, if at all, and help prevent the bottle from pivoting at such positions.

For example and without limitation, in embodiments, $W_{max}$ may be about 0.250±0.100 inches, and $W_{min}$ may be about 0.075±0.045 inches. Moreover, without limitation, for some embodiments the ratio of $W_{max}/W_{min}$ may be about 3.5:1. For other embodiments, the ratio of $W_{max}/W_{min}$ may range from about 2:1 up to about 8:1.

Figure 7:
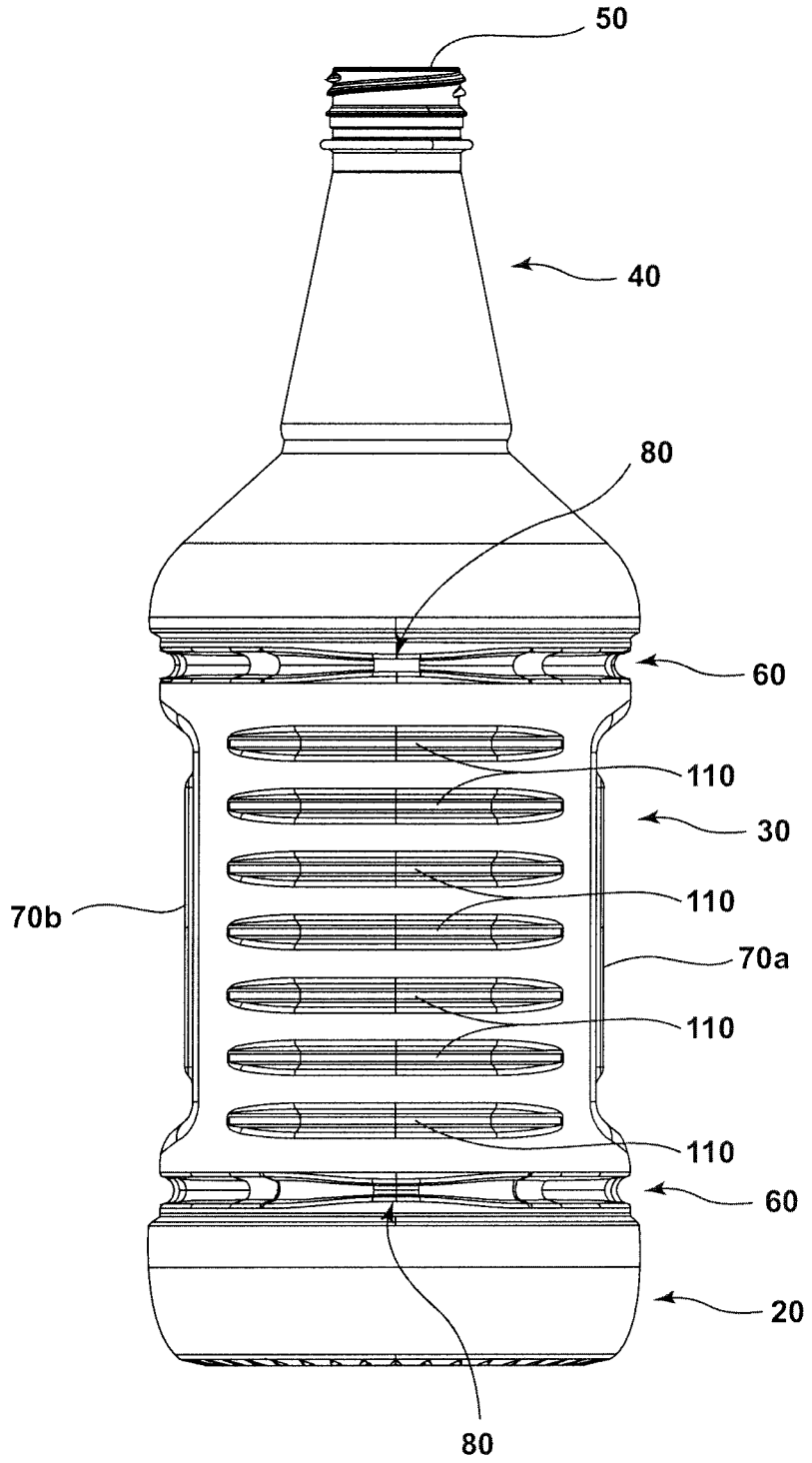
FIG. 7 illustrates a rear view of the container shown in FIG. 1.
Figure 8:
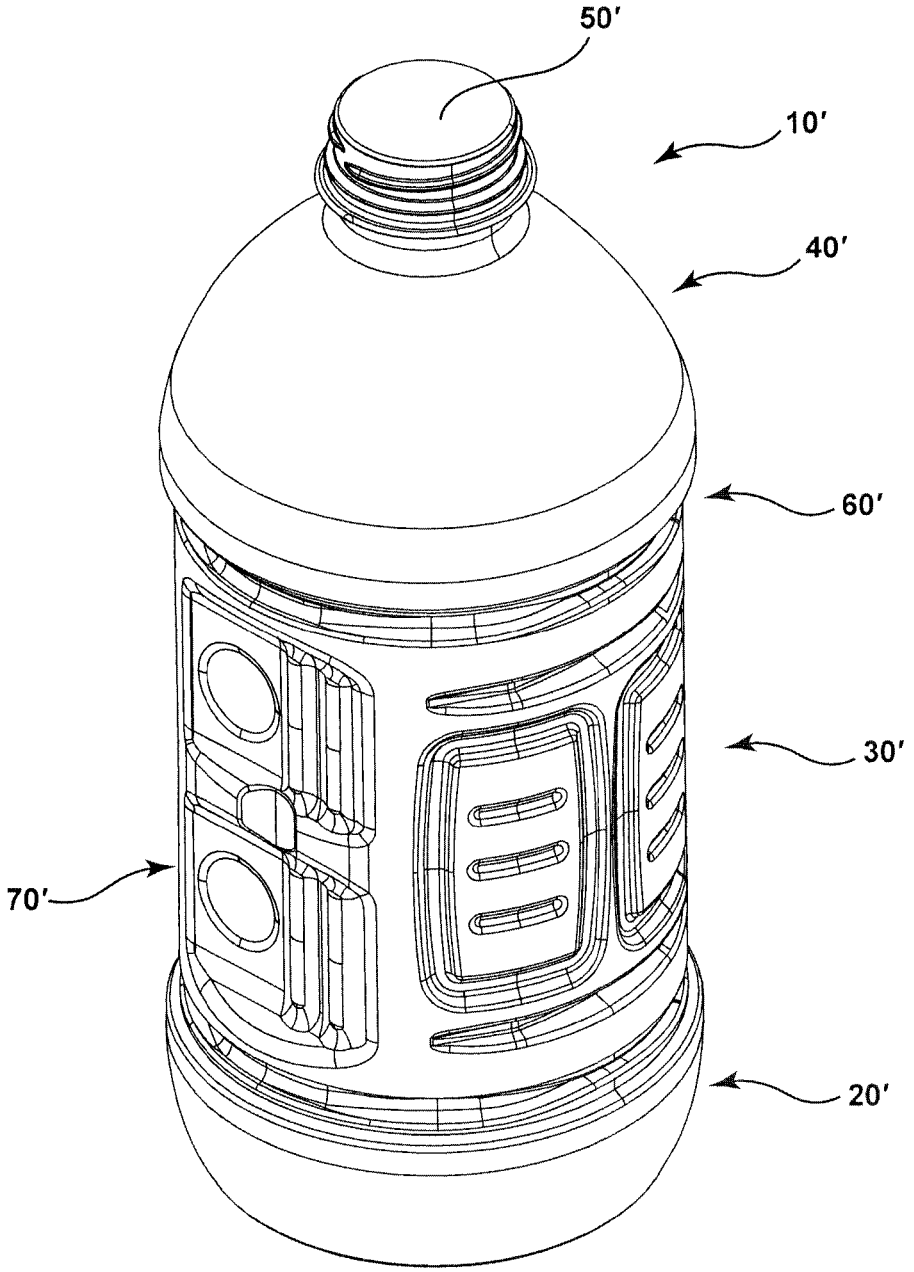
FIG. 8 generally illustrates an isometric view of a container according to another exemplary embodiment of the disclosure.
Figure 9:
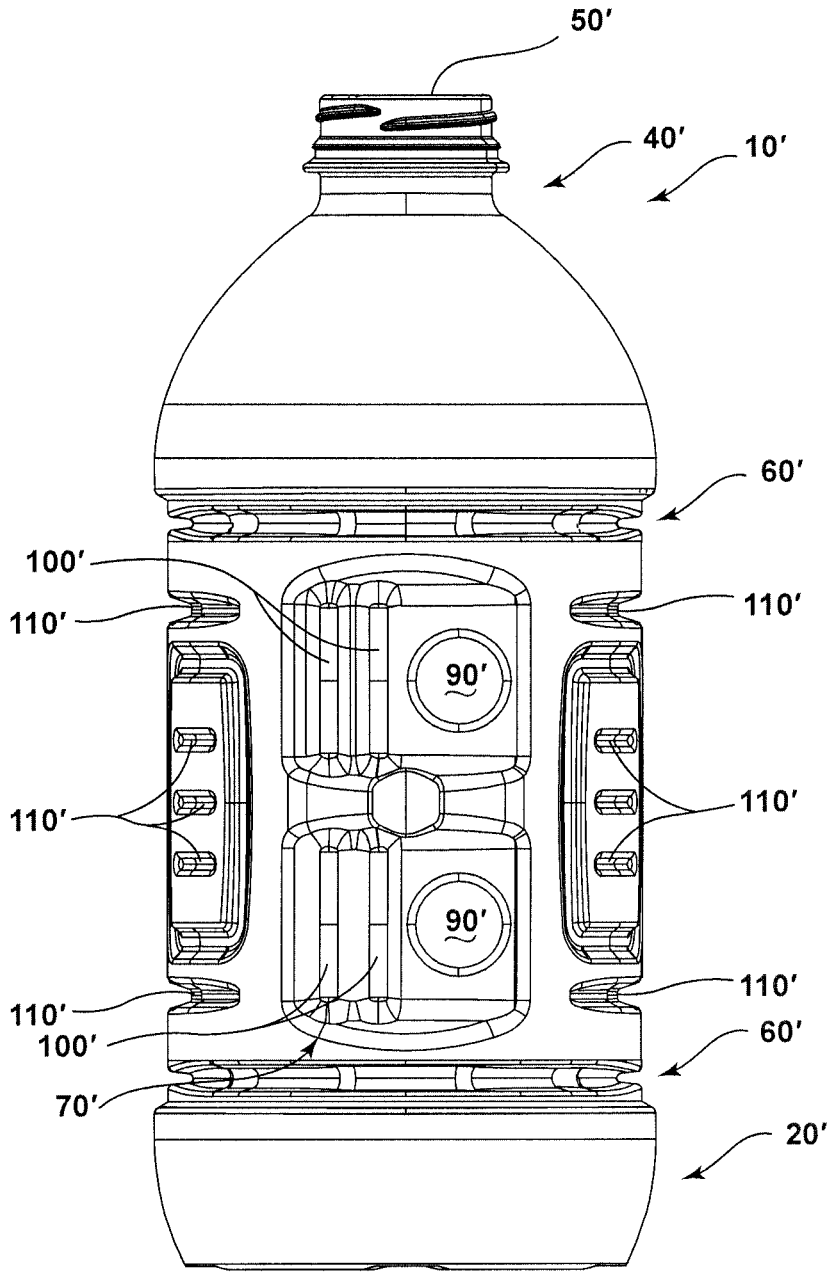
FIG. 9 illustrates a left side view of the container shown in FIG. 8.
Figure 10:
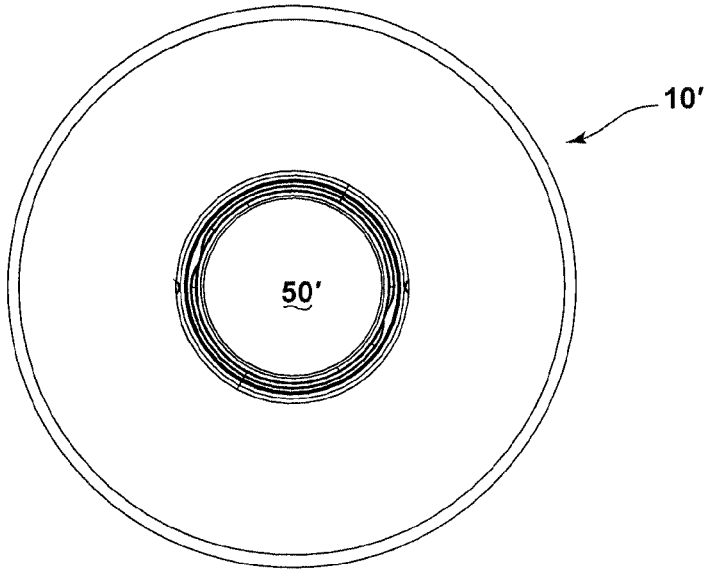
FIG. 10 illustrates a top plan view of the container shown in FIG. 8.
Figure 13:
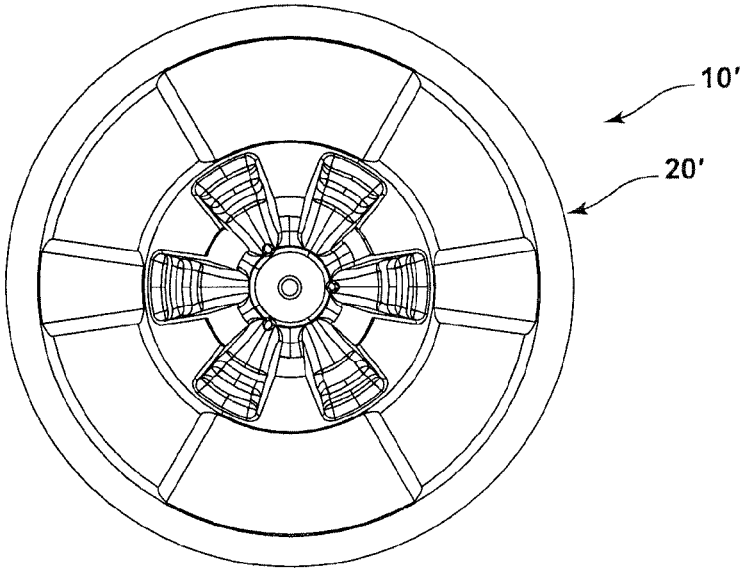
FIG. 13 illustrates a bottom plan view of the container shown in FIG. 8.
Figure 11:
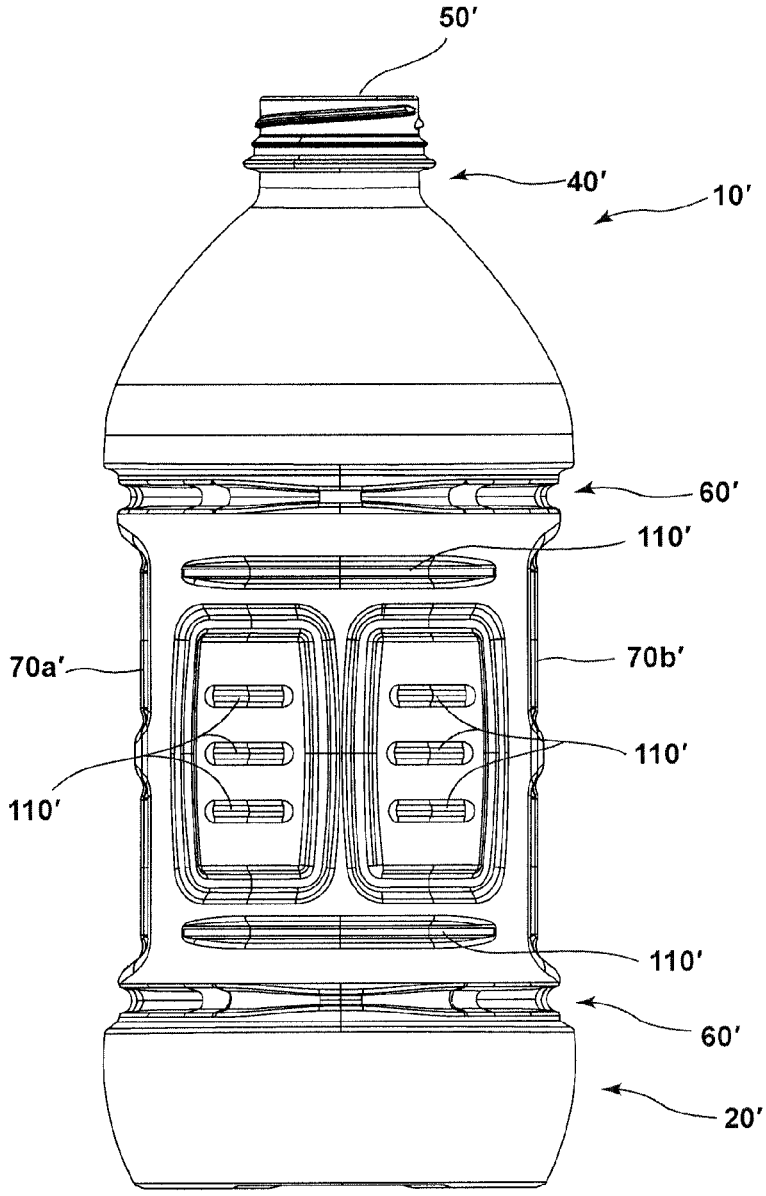
FIG. 11 illustrates a front view of the container shown in FIG. 8.
Figure 12:
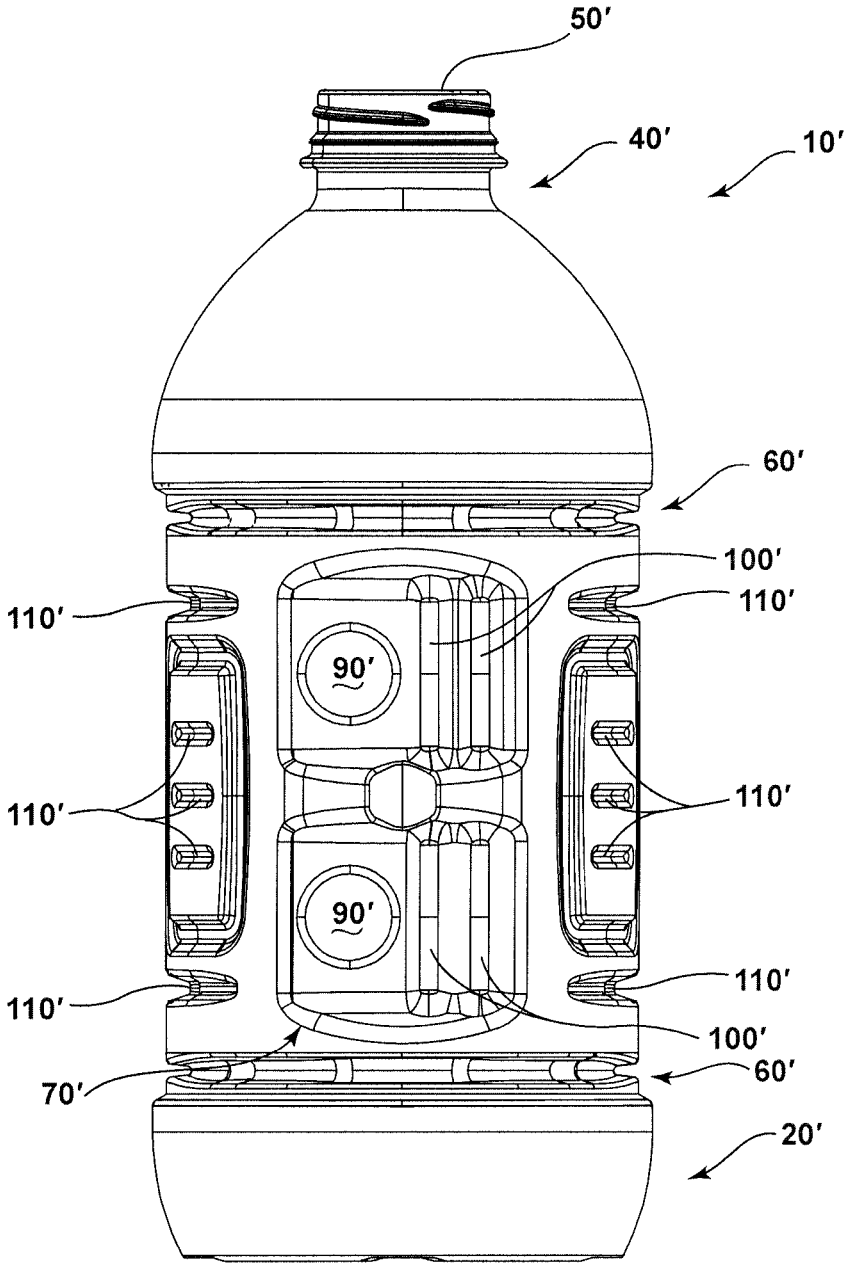
FIG. 12 illustrates a right side view of the container shown in FIG. 8.
Figure 14:
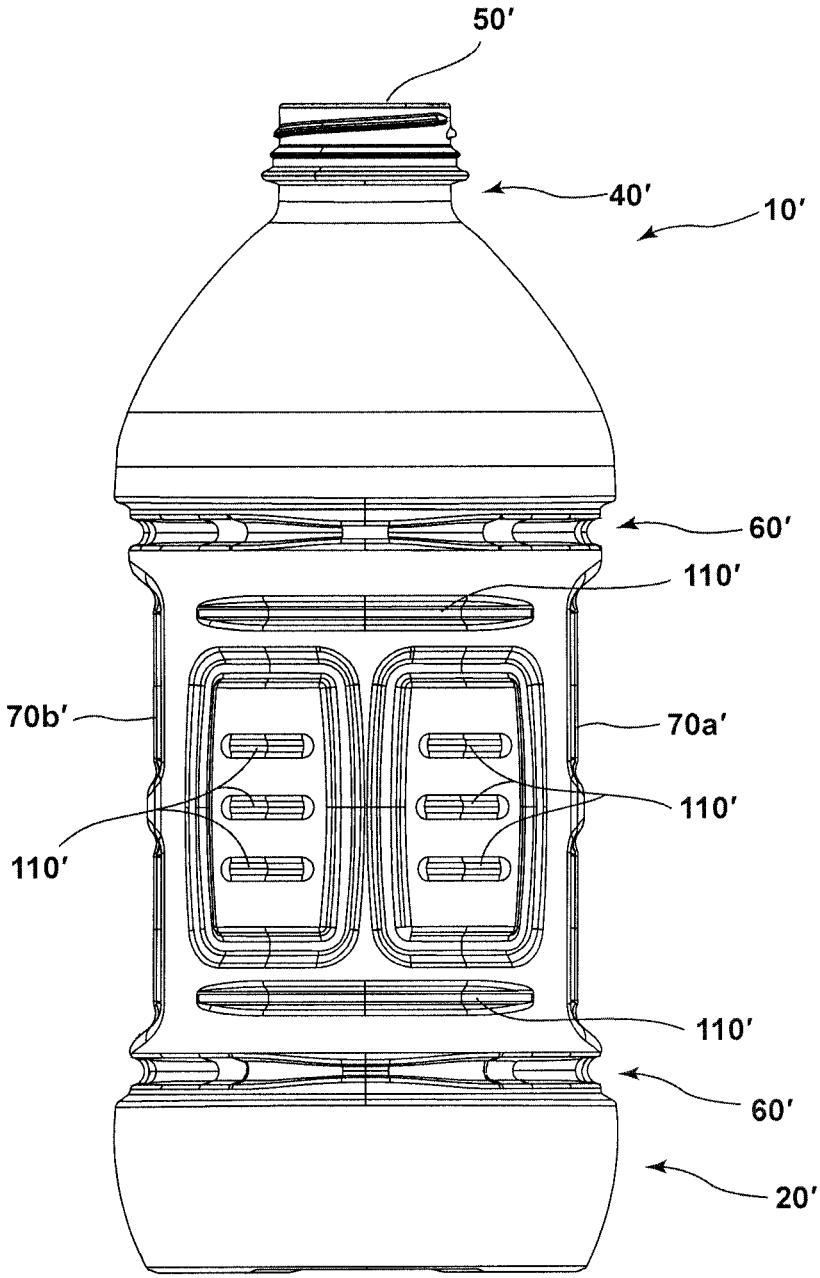
FIG. 14 illustrates a rear view of the container shown in FIG. 8.
Figure 15:
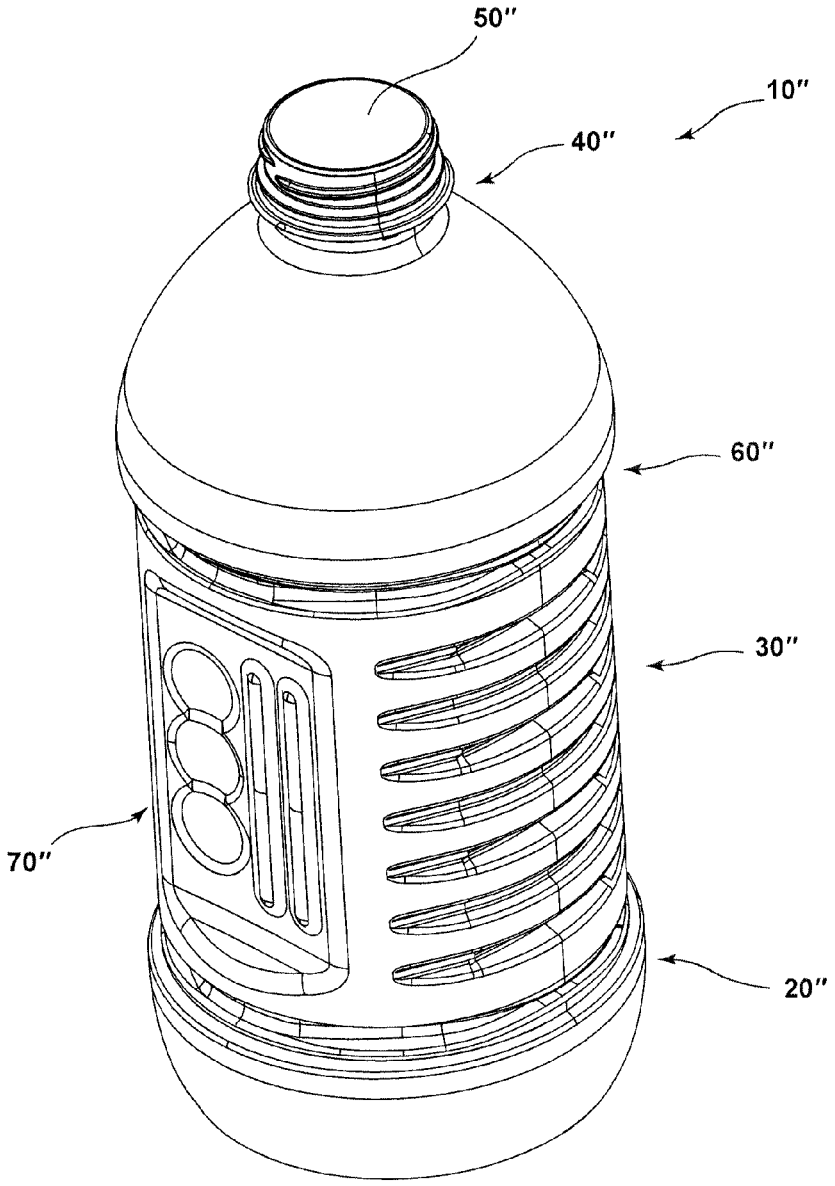
FIG. 15 generally illustrates an isometric view of a container according to still another exemplary embodiment of the disclosure.
Figure 16:
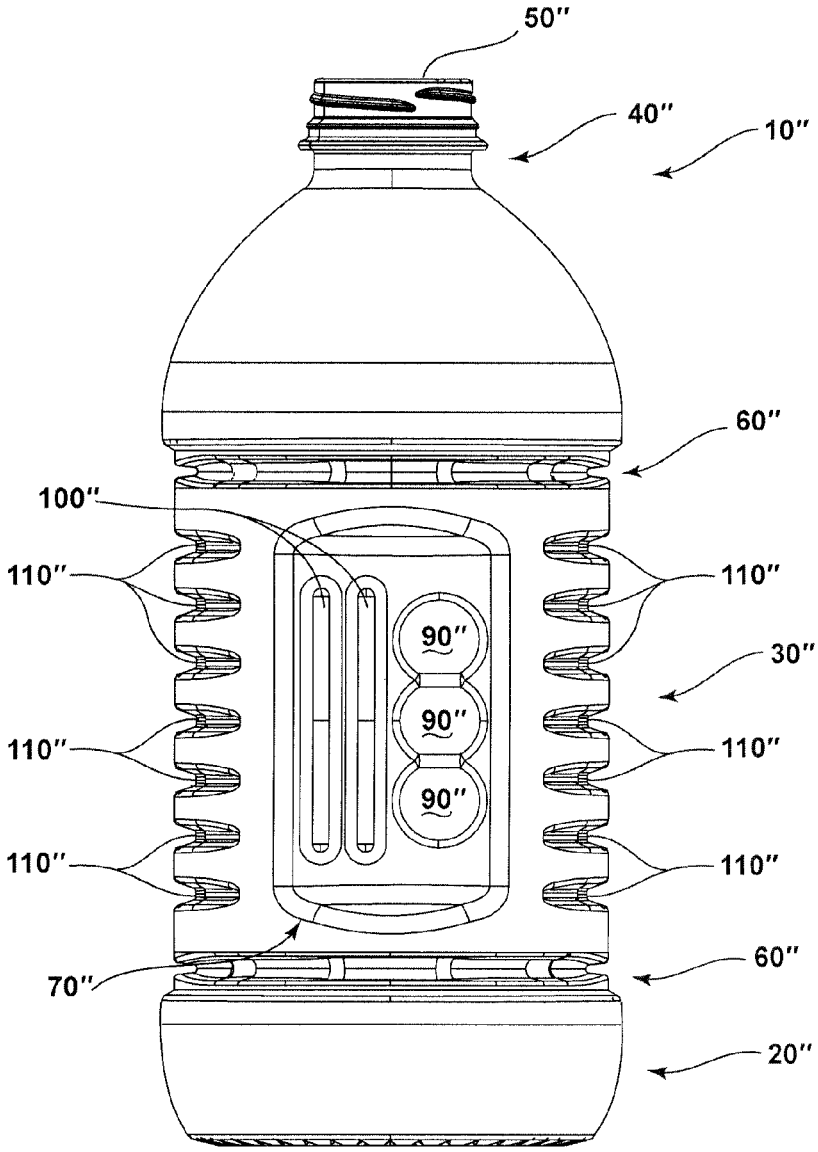
FIG. 16 illustrates a left side view of the container shown in FIG. 15.
Figure 17:
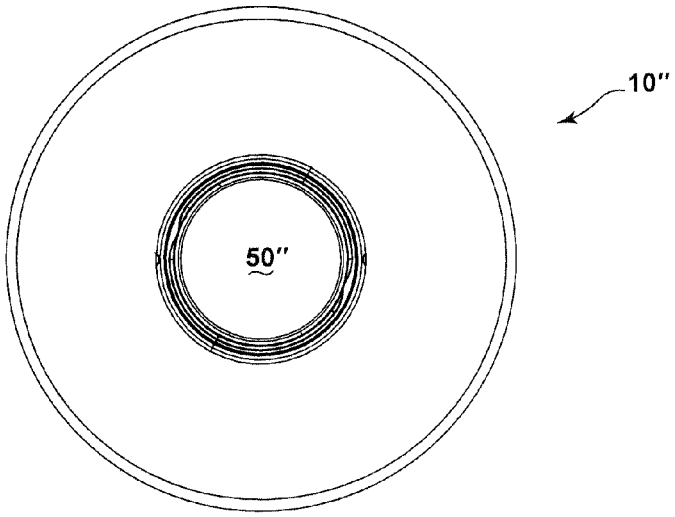
FIG. 17 illustrates a top plan view of the container shown in FIG. 15.
Figure 20:
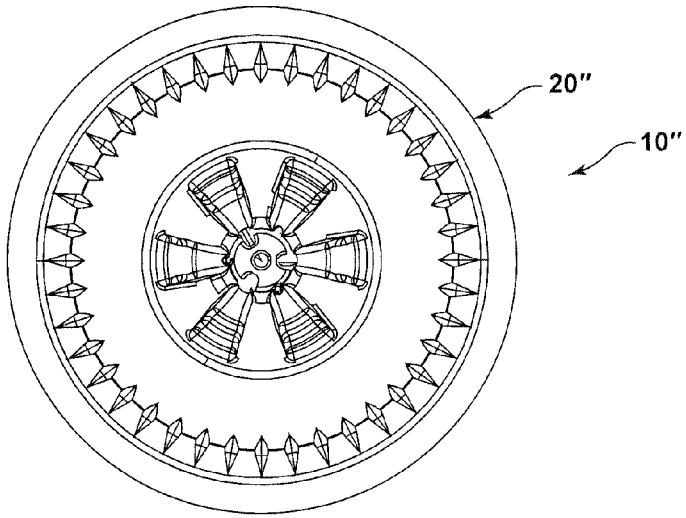
FIG. 20 illustrates a bottom plan view of the container shown in FIG. 15.
Figure 18:
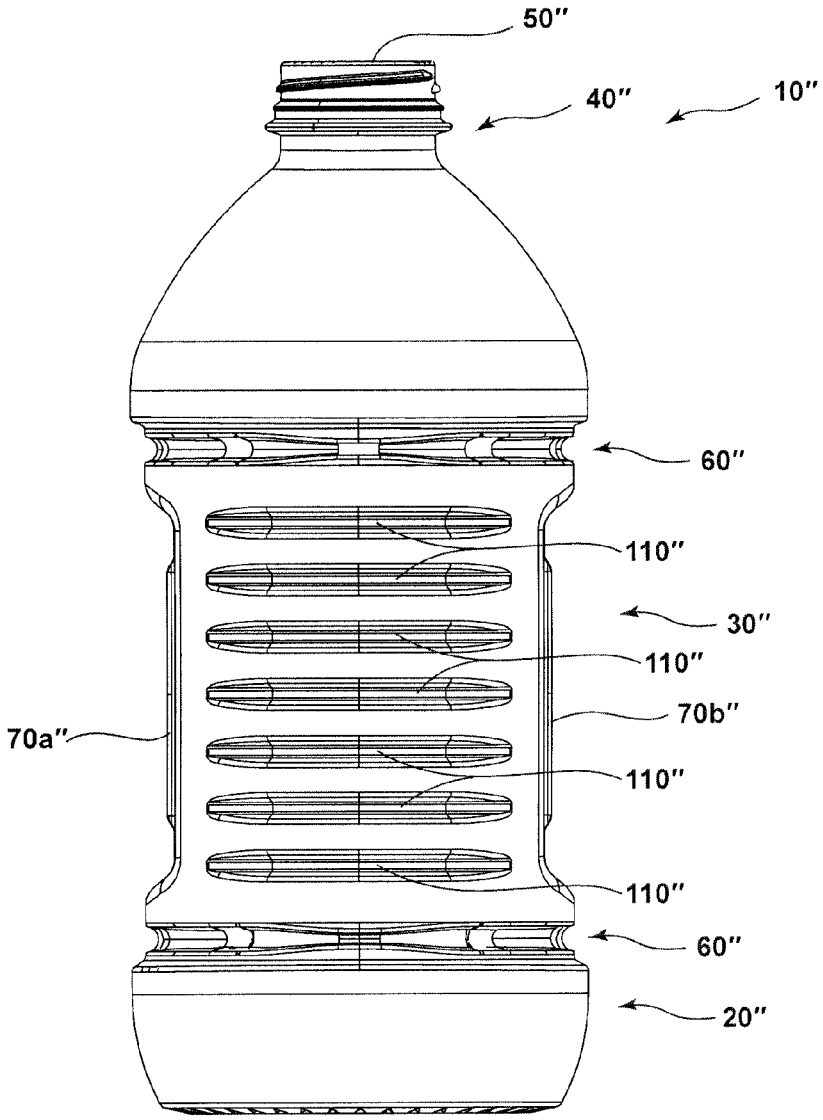
FIG. 18 illustrates a front view of the container shown in FIG. 15.
Figure 19:
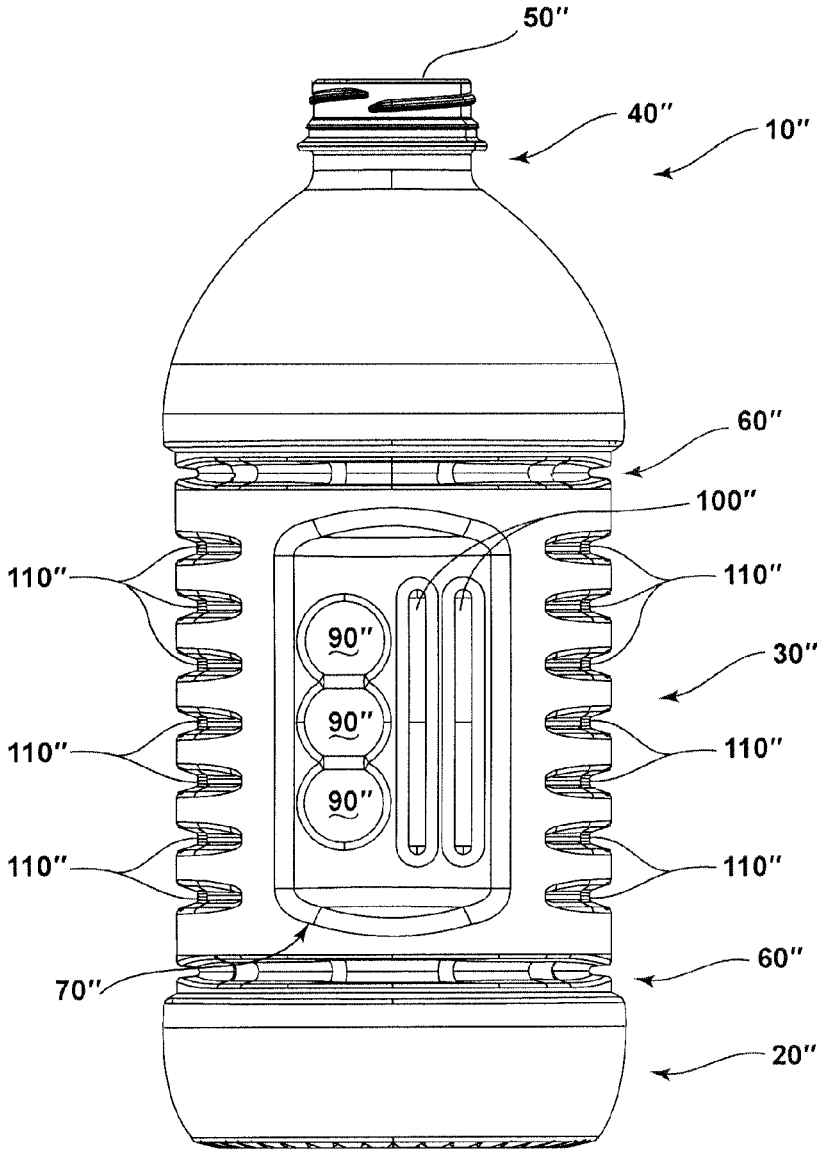
FIG. 19 illustrates a right side view of the container shown in FIG. 15.
Figure 21:
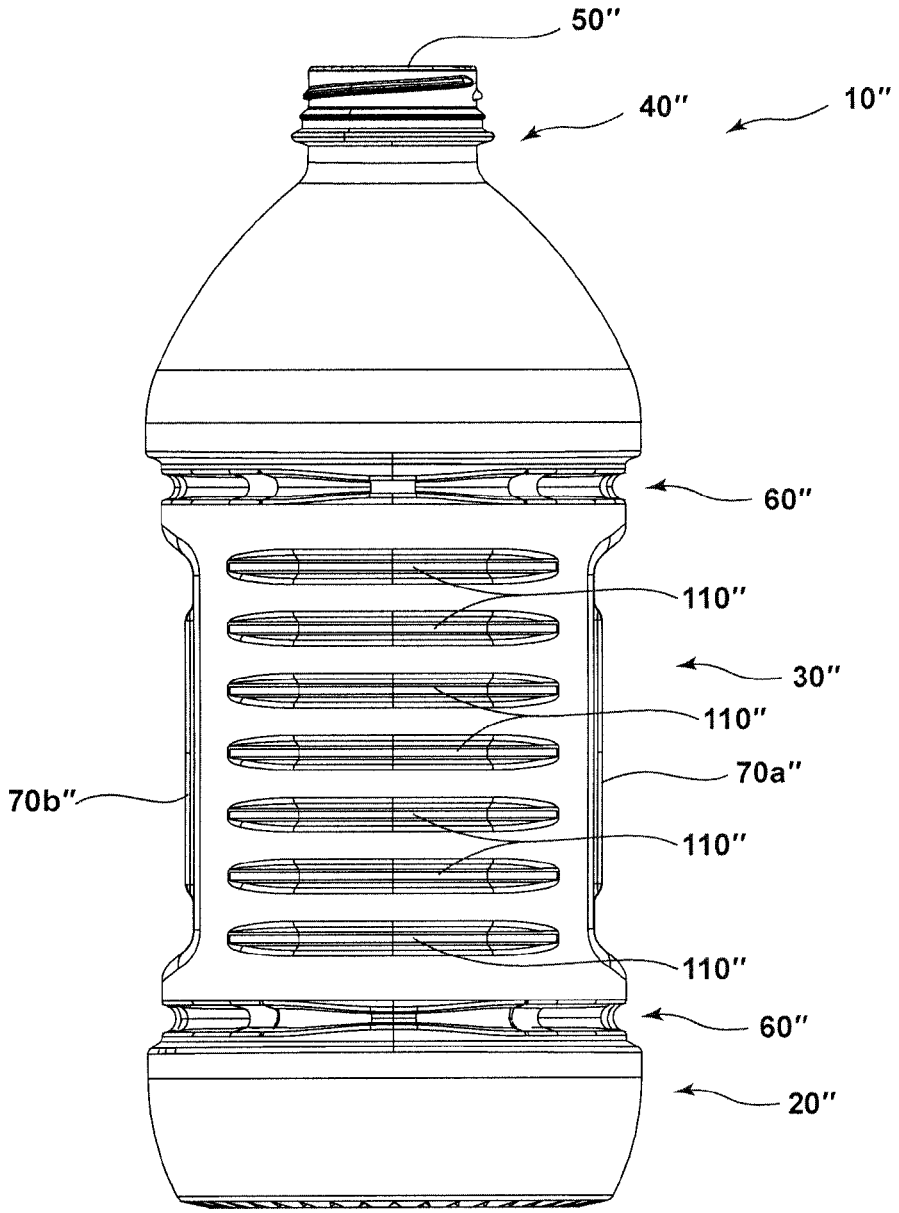
FIG. 21 illustrates a rear view of the container shown in FIG. 15.

As generally illustrated in FIGS. 4 and 7, the body portion may include a pair of grip panels 70 that are provided on opposite sides of the container. For example, a first grip panel 70*a* may be provided in the left side of the container, and a second grip panel 70*b* may be provided in the right side of the container. The grip panels 70*a*, 70*b* can be minor images of each another. The grip panels 70*a*, 70*b* can be configured to resists ovalization and other deformation during filling, product cooling, and handling. Further, as illustrated, the panels may be provided with various structural features including one or more various grip features. For example, without limitation, the grip features may include one or more circular recesses 90 (which can be configured to accommodate a user's finger) and/or one or more vertically-extending formations 100.

Figure 5:
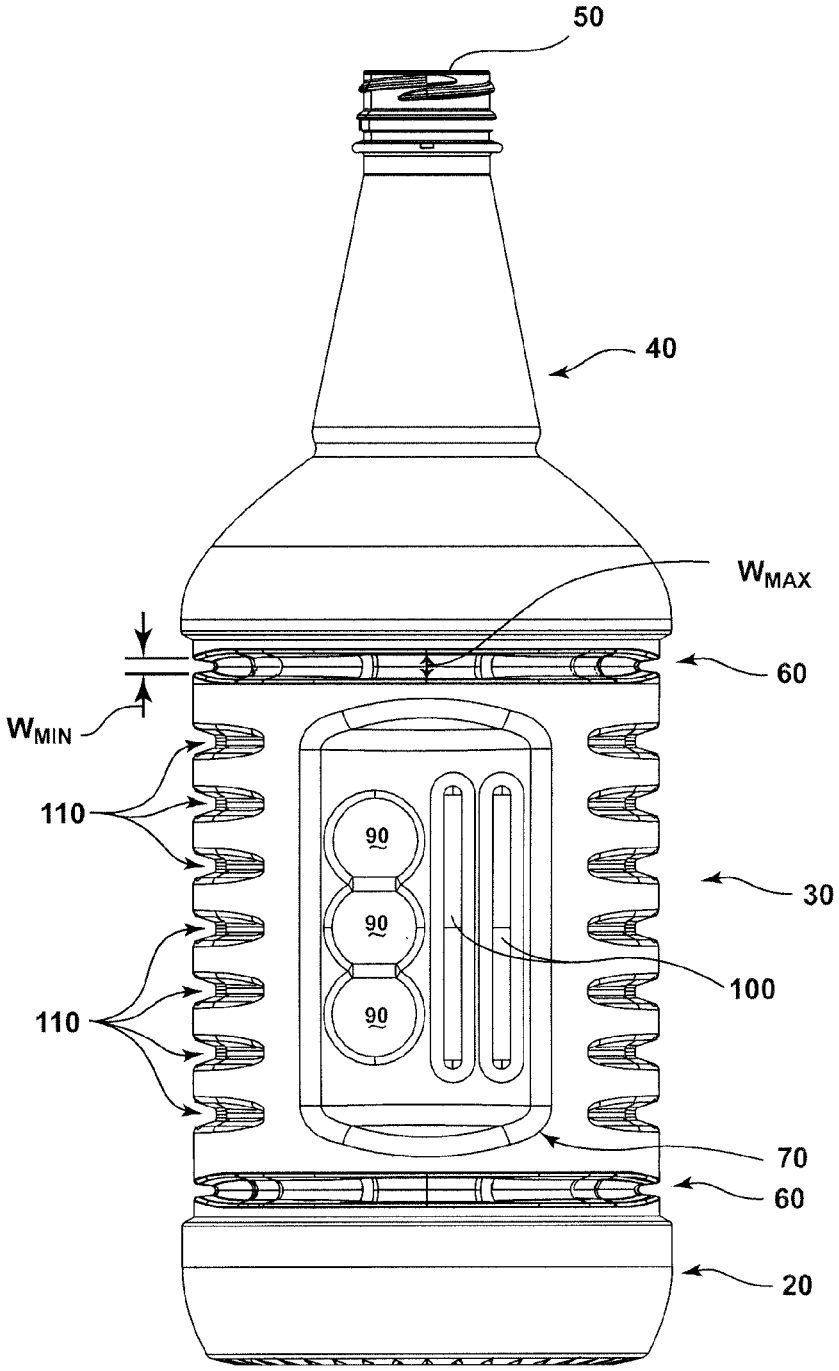
FIG. 5 illustrates a right side view of the container shown in FIG. 1.

In embodiments, grip panels 70*a*, 70*b* may be provided in the left side and right sides of a container. As generally illustrated in FIGS. 4 and 7, a pinch segment 80 of the annular rib 60 may be provided at approximately the circumferential center of the front and rear of the container—e.g., at 0° and 180° positions, respectively. At the same time, as generally illustrated in FIGS. 2 and 5, the annular rib 60 may be comparatively wider (e.g., having a vertical width up to or including $W_{max}$) at approximately the circumferential center of the left and right sides of the container—e.g., at 90° and 270° positions. Among other things, the narrowing of the annular rib 60 in the front (e.g., 0° position) and the rear (e.g., 180° position) can help keep the annular rib from "opening," which can help resist distortion. Further, as generally illustrated in the figures, the front and rear of the container (i.e., the portions that do not substantially include the grip portions 70*a*, 70*b*) may include one or more strengthening formations, such as a plurality of horizontal ribs 110, which may be recessed and can serve to resist deformation in the front and rear sides of the container. As generally illustrated, in embodiments, a plurality of strengthening formations (e.g., horizontal ribs 110) may be provided circumferentially offset from but within the same vertical height range as the grip portion 70.

Additionally, if desired, the grip panel 70 (or panels 70*a*, 70*b*) can be configured to be generally concave in a pre-vacuum condition. That is, by providing a generally concave profile, the panel 70 may be configured to have increased resistance to the pressure exerted by the contents (including hydrostatic pressure). It is noted that with embodiments, the grip panel 70 may be formed at an initial inwardly-bowed position with respect to the container circumference, and portions of the grip panel may be movable outwardly to a second position upon increased pressure during filling, and may be movable inwardly to a third position to accommodate the vacuum which forms in connection with product cooling. It is additionally noted that for some embodiments, the base may be configured to flex in response to internal pressure associated with contents, and portions of the base may be configured to absorb at least some of the internal vacuum forces encountered in connection with hot-fill applications. An example of a flexible base structure that may be employed in a hot-fill-type container is additionally disclosed in U.S. patent application Ser. No. 12/648,647, filed Dec. 29, 2009, which is incorporated herein in its entirety.

For some embodiments, an annular rib 60 with a variable vertical width may be provided above a grip panel 70 (or a plurality of panels, e.g., 70*a*, 70*b*). For other embodiments, an annular rib 60 with a variable vertical width may be provided below a grip panel 70 (or a plurality of panels, e.g., 70*a*, 70*b*). And for still other embodiments, such as those generally illustrated, at least one annular rib with a variable vertical width may be provided above a grip panel 70 (or a plurality of panels, e.g., 70*a*, 70*b*) with at least one annular rib with a variable vertical width provided below the grip panel 70 (or a plurality of panels, e.g., 70*a*, 70*b*).

The container may additionally include one or more labels. If desired, one or more labels can be applied, for example, to portions of the front and rear of the container that are circumferentially positioned between the grip panels 70*a*, 70*b*.

The plastic container 10 may be a molded plastic container that can, for example, be obtained from injection molding, injection stretch blow molding, extrusion blow molding, and/or compression molding. Plastic container 10 may be comprised of plastic in either a monolayer or multilayer configuration. In a monolayer configuration, plastic container 10 may be comprised of one of the following polymers: polyethylene (PE), polyethylene terephthalate (PET), high-density polyethylene (HDPE), polypropylene (PP), and other known polymers known in the container art. In a multilayer configuration, plastic container 10 may include two or more layers of polymers that are provided over all or portions of the container.

FIGS. 8 through 14 generally illustrate a container 10' according to another exemplary embodiment of the disclosure. The container 10' may include structural features as generally described and illustrated in the previous embodiment. As such, similar features have been numbered with common reference numerals but include a single apostrophe (e.g., 10', 20', 30', etc.). It should be appreciated that similar features are structured similarly, operate similarly, and/or have the same function unless otherwise indicated by the drawings or this specification. Among other things, the illustrated container 10' has a base 20', neck portion 40', and grip panels 70*a*' and 70*b*' having different configurations than those illustrated in connection with the embodiment of the container 10 illustrated in FIGS. 1 through 7. The illustrated upper and lower annular ribs 60' are, however, generally of the same type as previously disclosed.

FIGS. 15 through 21 generally illustrate a container 10" according to yet another exemplary embodiment of the disclosure. The container 10" may include structural features as generally described and illustrated in the previous embodiments. As such, similar features have been numbered with common reference numerals but include a double apostrophe (e.g., 10", 20", 30", etc.). It should be appreciated that similar features are structured similarly, operate similarly, and/or have the same function unless otherwise indicated by the drawings or this specification. The neck portion 40" of the container 10" is different (coming off a dome and being comparatively shorter). However, the base 20" and body portion 30", including grip panels 70*a*" and 70*b*", and upper and lower annular ribs 60" are very similar to those features illustrated in connection with the embodiment of the container 10 illustrated in FIGS. 1 through 7.

Although numerous embodiments of this invention have been described above with a certain degree of particularity, those skilled in the art could make numerous alterations to the disclosed embodiments without departing from the spirit or scope of this invention. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A plastic container comprising:

a base configured to support the container;

a neck portion including a dispensing opening; and a body portion including a horizontally-extending annular rib and a grip panel, wherein the horizontally-extending annular rib has a variable maximum vertical width and extends inwardly and substantially continuously around the circumference of the body portion, the annular rib has variable vertical width and includes a pinch segment with a minimum vertical width; the pinch segment is circumferentially and longitudinally offset from the grip panel; and the grip panel has a cross sectional shape that is non-circular.

2. The container of claim 1, wherein the pinch segment is circumferentially offset about 90° from a circumferential mid-portion of the grip panel.

3. The container of claim 1, wherein the body portion includes two grip panels, and the grip panels are provided on opposite sides of the container.

4. The container of claim 3, wherein the annular rib includes two pinch segments, the pinch segments each being circumferentially and longitudinally offset from the grip panels.

5. The container of claim 4, wherein the pinch segments are provided circumferentially at about 0° and 180° positions, and circumferential mid-portions of the grip panels are provided circumferentially at about 90° and 270° positions.

6. The container of claim 1, wherein the annular rib is provided vertically above the grip panel.

7. The container of claim 1, wherein the annular rib is provided vertically below the grip panel.

8. The container of claim 1, wherein the body portion includes at least two horizontally-extending annular ribs, each horizontally-extending annular rib having a variable vertical width and including a pinch segment.

9. The container of claim 8, wherein the grip panel is provided vertically between the at least two horizontally-extending annular ribs.

10. The container of claim 8, wherein the body portion includes two grip panels, the grip panels are provided on opposite sides of the container, and the grip panels are provided vertically between the at least two horizontally-extending annular ribs.

11. The container of claim 10, wherein the at least two horizontally-extending annular ribs each include pinch segments, the pinch segments each being circumferentially and longitudinally offset from the grip panels.

12. The container of claim 11, wherein the pinch segments of the at least two horizontally-extending annular ribs are provided circumferentially at about 0° and 180° positions, and circumferential mid-portions of the grip panels are provided circumferentially at about 90° and 270° positions.

13. The container of claim 1, wherein the grip panel includes a grip feature.

14. The container of claim 13, wherein the grip feature comprises a circular recess or vertically-extending formations.

15. The container of claim 1, wherein a plurality of structural reinforcing formations are provided vertically above or below the pinch segment.

16. The container of claim 1, wherein the base includes a base reinforcement formation.

17. The container of claim 1, wherein the base includes a portion configured to flex and absorb at least a portion of internal forces associated with container contents.

18. The container of claim 1, wherein the grip panel includes a concave portion.

19. The container of claim 1, wherein the annular grip transitions from a maximum vertical width to a minimum vertical width within a circumferential span of 35°.

20. The container of claim 1, wherein the annular rib has a maximum vertical width at circumferential positions provided at about 45°, 135°, 225°, and 315°.

21. A plastic container comprising:

a base configured to support the container;

a neck portion including a dispensing opening; and a body portion including a horizontally-extending annular rib that has a variable maximum vertical width and a grip panel that includes a concave portion, wherein the annular rib extends inwardly and substantially continuously around the circumference of the body portion, the annular rib has variable vertical width and includes a pinch segment; the pinch segment is circumferentially and longitudinally offset from the grip panel; and the grip panel has a cross sectional shape that is non-circular.

* * * * *